United States Patent [19]

Bischof et al.

[11] Patent Number: 4,977,693

[45] Date of Patent: Dec. 18, 1990

[54] DEVICE FOR DAMPING AND LIMITING THE TILTING ACTION OF THE CUFF RELATIVE TO THE SHELL OF A SKI BOOT

[75] Inventors: Horst Bischof, Graz; Gerhard Trinkaus, Baernbach, both of Austria

[73] Assignee: Koflach Sport Gesellschaft mbH & Co. KG, Voecklabruck, Austria

[21] Appl. No.: 277,947

[22] Filed: Nov. 30, 1988

[30] Foreign Application Priority Data

Dec. 1, 1987 [AT] Austria ..... 3158/87

[51] Int. Cl.[5] ..... A43B 5/04

[52] U.S. Cl. ..... 36/120; 36/117

[58] Field of Search ..... 36/117–121, 36/54

[56] References Cited

U.S. PATENT DOCUMENTS

| | | | |
|---|---|---|---|
| 4,381,613 | 5/1983 | Lederer . | |
| 4,447,970 | 5/1984 | Delery . | |
| 4,455,769 | 6/1984 | Fritsch . | |
| 4,677,771 | 7/1987 | Arieth et al. | 36/120 |
| 4,685,225 | 8/1987 | Hensler . | |
| 4,733,484 | 3/1988 | Delery | 36/120 |

FOREIGN PATENT DOCUMENTS

| | | | |
|---|---|---|---|
| 0172159 | 2/1986 | European Pat. Off. . | |
| 217423 | 4/1987 | European Pat. Off. | 36/117 |
| 241840 | 10/1987 | European Pat. Off. | 36/117 |
| 252417 | 1/1988 | European Pat. Off. | 36/117 |
| 2425207 | 10/1979 | France . | |
| 2557776 | 7/1985 | France . | |

*Primary Examiner*—Paul T. Sewell
*Assistant Examiner*—A. Meyers
*Attorney, Agent, or Firm*—Peter E. Rosden

[57] ABSTRACT

In a device for damping and limiting the tilting motion of a cuff relative to the shell (2) of a ski boot (1), wherein a damping element is disposed between shell (2) and cuff (3) said element being subjected to pressure when cuff (3) tilts forward, the damping element is made of a molded body (8) of elastomeric material that is triangular or trapezoidal when viewed from above, with molded body (8) preferably being disposed in a housing (6) on or in shell (2).

6 Claims, 2 Drawing Sheets

Figure 1:
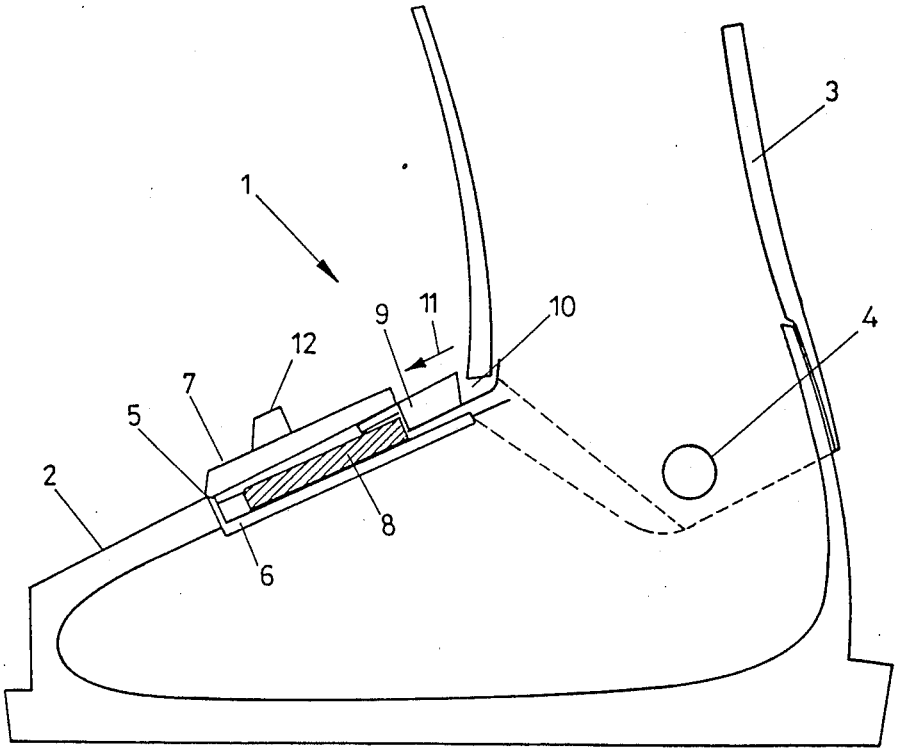

DEVICE FOR DAMPING AND LIMITING THE TILTING ACTION OF THE CUFF RELATIVE TO THE SHELL OF A SKI BOOT

The invention relates to a device for damping and limiting the tilting action of the cuff relative to the shell of a ski boot, wherein a damping element is disposed between the shell and cuff, said element being subjected to compressive stress when the cuff tilts forward.

A method is already known for damping and limiting the tilting action of a cuff relative to a shell of a ski boot, wherein a stop is disposed on the shell, against which stop the cuff strikes when it tilts forward. The resultant limitation of the tilting motion is accomplished largely without damping, and any damping that does in fact occur can be attributed only to the material characteristics and/or deformability of the cuff. It is also already known that elastically deformable parts, especially strips, can be inserted between the contact edge of the shell and a matching edge on the cuff, said parts providing essentially linear damping up to the stop and hence until the tilting is arrested. According to another known embodiment, displaceably mounted locking members are inserted in a slot between the shell and cuff, said slot running in the circumferential direction of the shell, said members producing a more or less pronounced limitation and damping of the tilting motion by shifting in the lengthwise direction of the slot as a result of the intrinsic elasticity of the material of which the cuff is made. When a displaceable locking member of this kind is slid into the vicinity of the lengthwise central plane of the boot, limitation of the tilting motion naturally occurs earlier than when such a locking member is displaced into a lateral position against the shell near the sole.

The goal of the invention therefore is to create a device of the type recited hereinabove, by means of which progressive damping can be provided and which offers the possibility to change the damping characteristics in simple fashion simultaneously with such progressive damping. To achieve this goal, the design according to the invention essentially consists in the damping element being made of a molded body of elastomeric material which is triangular or trapezoidal as viewed from above, the geometric height of said body being arranged to lie in the direction of the lengthwise central plane of the boot. The fact that a molded body with a triangular or trapezoidal shape and made of elastomeric material is used as the damping element produces progressive damping because of the basic geometric shape if, as proposed according to the invention, the geometric height of this molded body is arranged to lie in the direction of the lengthwise central plane of the boot. A triangular and/or trapezoidal molded body of this kind also makes it possible to influence the damping characteristics in an especially simple fashion, as is made possible by preferred embodiments of the design according to the invention.

To allow precise and permanent installation of the molded body, the design is advantageously made such that the tip of the triangular molded body or the narrower of the mutually parallel sides of the trapezoid is pointed toward the toe of the boot. In a design of this type, the parallel side of the trapezoid which is longer in a given case, or the base of the triangle, is pointed toward the cuff and the molded body can be securely and permanently positioned at the top or in the shell. This positioning can be advantageously accomplished by disposing the molded body in a housing on or in the shell; a housing of this kind can be made in the form of a recess in the shell. A housing of this kind also has the effect that a convexity in the molded body is elevated out of its plane, so that adjustment and/or shifiting of the damping characteristics can be performed precisely and accurately.

To adjust the damping characteristics of the molded body, the design is advantageously made such that the housing has adjustable lateral stops which are adjustable to the mutually convergent lateral surfaces of the molded body and can be locked in the selected position. The fact that adjustable lateral stops are provided means that the elastic deformation of the elastomeric material can be limited selectively and a more or less pronounced change in the progressive damping characteristics is achieved depending on the contact of these lateral stops with the triangular or trapezoidal molded body.

Acording to an especially simple design for adjusting the damping characteristics, the lateral stops are formed by projections pivotably articulated near the tip or narrower parallel side of the molded body, said projections being pivotable relative to the mutually convergent lateral surfaces of the molded body and lockable in their pivoting motion. By locking such pivotable stops a portion of the length of the lateral surfaces of the molded body which matches the length of these pivotable stops can be protected against further deformation, and the elastic deformation can thus be reduced to the desired extent. Advantageously, the pivotably articulated projections have a length which is less than the length of the mutually convergent lateral surfaces of the molded body; in view of the preferred articulation of the pivotable stops near the apex of the triangle and/or the narrower parallel side of the trapezoid, the change in the damping characteristics makes itself felt primarily in the first partial area of deformation of the damping element.

In an especially advantageous manner, the design according to the invention is made such that the pivotably articulated projections are overlapped by a locking member which is mounted in the housing so as to be displaceable and lockable in the direction of the geometric height of the molded body, and cooperates with the pivotable projections to delimit the pivoting motion of the pivotable projections, thus permitting in simple fashion an adjustment of the admissible elastic deformation by application of small adjusting forces. Because of the lever advantage provided by the pivotable stops, their pivotability can be limited with relatively small force, and considerable elastic deforming forces can be reliably taken up by relatively small supporting forces.

This limitation of the pivotability of the lateral stops while accepting a small amount of force is accomplished in especially simple fashion by virtue of the fact that the locking element on its inner side facing the convergent lateral surfaces of the molded body, has supporting surfaces that converge in the same direction as the lateral surfaces.

The invention will now be described in greater detail with reference to an embodiment shown in the drawing. FIG. 1 is a side view of a ski boot with a device for damping and limiting the tilting motion of the cuff, and FIG. 2 is an exploded view of an especially preferred device for limiting and progressively damping the tilting motion of the boot, as can be used for a boot according to FIG. 1.

In FIG. 1, the shell of a ski boot 1 is labelled 2. A cuff 3 is articulated to this shell 2, with tilting axis 4 located approximately in the area of the ankle bone. An inner (liner) is located in known fashion inside shell 2 and cuff 3, but is not shown, for the sake of clarity.

A recess 5 is provided in the instep area of shell 2, in which recess a housing composed of a lower part 6 and an upper part 7 is located to receive a molded body 8 made of elastomeric material and designed to serve as a damping element. A stop member 9 cooperates with molded body 8 in housing 6, said member 9 having an engagement point 10 for cuff 3, at the end away from the toe of the boot. When cuff 3 tilts around axis 4 in the direction of the boot toe, stop member 9 shifts toward the boot toe and runs up onto molded body 8 housed in the lower part of the housing, so that the pivoting motion of cuff 3 is damped and limited. An actuating element 12 is also indicated on housing upper part 7, by means of which the damping characteristics can be adjusted, as described in greater detail hereinbelow.

Figure 2:
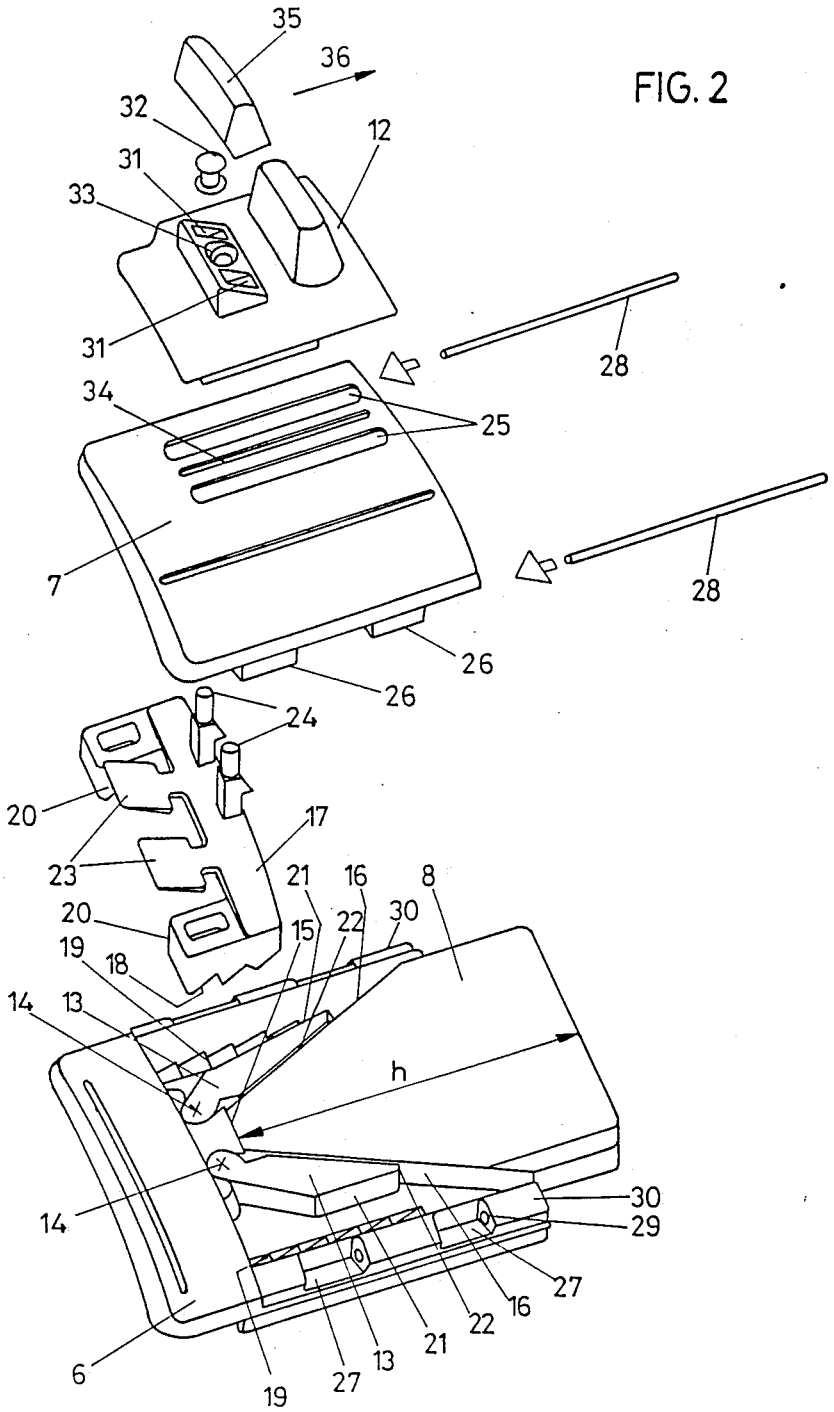

In the exploded view shown in FIG. 2, of a preferred device for limiting and progressively damping and tilting motion of cuff 3, the housing lower part for receiving molded body 8 and located in recess 5 of shell 2 is again labelled 6. As FIG. 2 shows, molded body 8 is essentially trapezoidal; the parallel arrangement of the lateral surfaces, provided in the vicinity of the longer of the two mutually parallel lateral edges of the trapezoid, ensures reliable guidance of stop member 9, which cooperates with cuff 3 and is not shown, for the sake of clarity, in FIG. 2. The selected trapezoidal or nearly triangular design of molded body 8, made of elastomeric material, produces progressive damping because of the basic geometric shape if, as shown in FIG. 2, the geometric height h of molded body 8 is disposed to run in the direction of the lengthwise central plane of the boot. In housing 6, additional adjustable stops 13 are mounted free to pivot around axes schematically indicated by 14; these pivotable stops 13 are located near the apex or the narrower side 15 of the mutually parallel sides of the trapezoid. As is shown clearly in FIG. 2, pivotably mounted projections 13 are pivotable relative to mutually convergent lateral surfaces 16 of molded body 8 and are overlapped by a locking member 17, said member cooperating by means of teeth located on both sides with teeth 19 located on the bottom of housing lower part 6, and lockable in different positions. Locking member 17 has on the inner sides facing the convergent lateral surfaces 16 of molded body 8, convergent supporting surfaces 20 each of which runs in the same direction as the lateral surfaces of the molded body, said surfaces cooperating with outer surfaces 21 of the corresponding adjacent pivotable extensions 13. To permit a certain plastic deformation of molded body 8 when stressed by stop element 9 cooperating with the cuff, the design is made such that when pivotable projections 13 are overlapped by locking member 17 and are in the unstreesed state, depending on the locking position of locking member 17, gaps of different sizes are left between convergent lateral surfaces 16 and inner surfaces 22 pf each projection, to permit deformation of the molded body to a limited extent. The adjustment of locking member 17 and the resultant limitation of the deformation of molded body 8 produces a more or less pronounced change in the progressive clamping characteristic. In each case, a corresponding part of the length of lateral surfaces 16 or molded body 8 is deformable to only a limited extent, so that overall elastic deformation can be reduced to the desired degree. In order to ensure a certain minimum degree of deformation, however, pivotable projections 13 extend over only a part of convergent lateral surfaces 16, as clearly shown in FIG. 2.

To secure the locking member in the desired position in housing 6, the latter has elastic projections 23 on its upper surface, said projections abutting the inside of housing upper part 7 when said part is put in place, and ensure the desired positioning. In addition, locking member 17 has actuating projections 24 which project through elongated holes 25 in upper housing part 7 when the entire housing is assembled and permit simple adjustment of the desired damping characteristics at all times. As shown schematically in FIG. 2, housing upper part 7 with projections 26 engages recesses provided in housing lower part 27; to lock the two housing parts together, rod-shaped elements 28 are provided which project through holes in projections 26 of the housing upper part and through holes 29 in projections 30 of the housing lower part, thus permitting secure assembly of the device according to the invention.

FIG. 2 also shows actuating element 12 for changing the locking position of locking member 17, which is mounted on the housing cover in the assembled state. Actuating projections 24 of locking member 17 project through openings 31 provided in the actuating element. Actuating element 12 is then fastened to cover 7 by a pin 32 guided through a hole 33 in actuating element 12 in a slot 34 in cover 7. An actuating knob 35 cooperates with actuating projections 24 projecting through openings 31 to adjust locking member 17; when tensile stress is applied to knob 35 in the direction of arrow 36, by means of actuating projections 24, the pivoting of entire locking member 17 causes teeth 18 and 19 to disengage; by moving entire actuating element 12, which is displaceable in the lengthwise direction of the boot by means of pin 32 in elongated hole 14 in the housing cover, a new position for locking member 17 is selected and a different damping characteristic can be set as well.

We claim:

1. In a device for use with a ski boot, comprising:
a shell covering at least the instep region of the foot;
a cuff part tiltably attached to said shell;
damping means situated between said shell and said cuff part for limiting and controlling the tilting motion of said cuff part, wherein said damping means is further comprised of
a generally triangularly shaped body with mutually convergent lateral surfaces molded from an elastomeric material wherein the geometric height of said body extends along the lengthwise central plane of the boot with the narrower end thereof oriented in the direction of the toe of the boot;
a housing located on said shell for receiving said body; the improvement comprising
adjustable lateral stop means connected to said housing for locking said body in an adjustable and selectable position by cooperation with the mutually convergent lateral surfaces of said body.

2. A device for use with a ski boot, comprising:
a shell covering at least the instep region of the foot;
a cuff part tiltably attached to said shell;
damping means situated between said shell and said cuff part for limiting and controlling the tilting motion of said cuff part, wherein said damping means is further comprised of a generally triangularly shaped body with mutually convergent lateral surfaces molded from an elastomeric material wherein the geometric height of said body extends along the lengthwise central plane of the boot with the narrower end thereof oriented in the direction of the toe of the boot;

a housing located on said shell for receiving said body;

a pair of adjustable lateral stops pivotably connected to said housing wherein said stops are lockable in a selected position against the mutually convergent lateral surfaces of said body near the narrower end thereof and wherein the length of said stops is less than the length of the mutually convergent lateral surfaces of said body; and a locking member having convergent supporting surfaces extending in the same direction as and facing the mutually convergent lateral surfaces of said body, wherein said locking member is placed in a position overlapping said stops and is lockable to said housing and wherein the position of said locking member is displaceable in the direction of the geometric height of said body and limits the pivoting motion of said stops.

3. A device for use with a ski boot, comprising:

a shell covering at least the instep region of the foot;

a cuff part tiltably attached to said shell;

damping means situated between said shell and said cuff part for limiting and controlling the tilting motion of said cuff part, wherein said damping means is further comprised of a generally triangularly shaped body with mutually convergent lateral surfaces molded from an elastomeric material wherein the geometric height of said body extends along the lengthwise central plane of the boot with the narrower end thereof oriented in the direction of the toe of the boot;

a housing located on said shell for receiving said body; and adjustable lateral stop means connected to said housing for locking said body in an adjustable and selectable position by cooperation with the mutually convergent lateral surfaces of said body wherein said adjustable lateral stop means are projections pivotably articulated near the narrower end of said body and lockable with the mutually convergent lateral surfaces of said body during pivoting.

4. A device for use with a ski boot, comprising:

a shell covering at least the instep region of the foot;

a cuff part tiltably attached to said shell;

damping means situated between said shell and said cuff part for limiting and controlling the tilting motion of said cuff part, wherein said damping means is further comprised of a generally triangularly shaped body with mutually convergent lateral surfaces molded from an elastomeric material wherein the geometric height of said body extends along the lengthwise central plane of the boot with the narrower end thereof oriented in the direction of the toe of the boot;

a housing located on said shell for receiving said body; and adjustable lateral stop means connected to said housing for locking said body in an adjustable and selectable position by cooperation with the mutually convergent lateral surfaces of said body wherein said adjustable lateral stop means are projections pivotably articulated near the narrower end of said body and lockable with the mutually convergent lateral surfaces of said body during pivoting and wherein the length of said adjustable lateral stop means is less than the length of the mutually convergent lateral surfaces of said body.

5. A device for use with a ski boot, comprising:

a shell covering at least the instep region of the foot;

a cuff part tiltably attached to said shell;

damping means situated between said shell and said cuff part for limiting and controlling the tilting motion of said cuff part, wherein said damping means is further comprised of a generally triangularly shaped body with mutually convergent lateral surfaces molded from an elastomeric material wherein the geometric height of said body extends along the lengthwise central plane of the boot with the narrower end thereof oriented in the direction of the toe of the boot;

a housing located on said shell for receiving said body;

adjustable lateral stop means connected to said housing for locking said body in an adjustable and selectable position by cooperation with the mutually convergent lateral surfaces of said body wherein said adjustable lateral stop means are projections pivotably articulated near the narrower end of said body and lockable with the mutually convergent lateral surfaces of said body during pivoting and wherein the length of said adjustable lateral stop means is less than the length of the mutually convergent lateral surfaces of said body; and a locking member placed in a position overlapping said stop means and lockable to said housing, wherein the position of said locking member is displaceable in the direction of the geometric height of said body and limits the pivoting motion of said stops.

6. A device for use with a ski boot, comprising:

a shell covering at least the instep region of the foot;

a cuff part tiltably attached to said shell;

damping means situated between said shell and said cuff part for limiting and controlling the tilting motion of said cuff part, wherein said damping means is further comprised of a generally triangularly shaped body with mutually convergent lateral surfaces molded from an elastomeric material wherein the geometric height of said body extends along the lengthwise central plane of the boot with the narrower end thereof oriented in the direction of the toe of the boot;

a housing located on said shell for receiving said body;

adjustable lateral stop means connected to said housing for locking said body in an adjustable and selectable position by cooperation with the mutually convergent lateral surfaces of said body wherein said adjustable lateral stop means are projections pivotably articulated near the narrower end of said body and lockable with the mutually convergent lateral surfaces of said body during pivoting and wherein the length of said adjustable lateral stop means is less than the length of the mutually convergent lateral surfaces of said body; and a locking member placed in a position overlapping said stop means and lockable to said housing, wherein the position of said locking member is displaceable in the direction of the geometric height of said body and limits the pivoting motion of said stops and wherein said locking member has convergent supporting surfaces extending in the same direction as and facing the mutually convergent lateral surfaces of said body.

* * * * *